US007122098B1

(12) United States Patent
Tadokoro et al.

(10) Patent No.: US 7,122,098 B1
(45) Date of Patent: Oct. 17, 2006

(54) PAPER QUALITY IMPROVER FOR PAPERMAKING AND METHOD FOR PRODUCING PULP SHEET

(75) Inventors: Takaaki Tadokoro, Wakayama (JP); Yasushi Ikeda, Wakayama (JP); Toshiyuki Nishimori, Wakayama (JP); Hiromichi Takahashi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/473,055

(22) Filed: Dec. 28, 1999

(30) Foreign Application Priority Data

| | | |
|---|---|---|
| Dec. 28, 1998 | (JP) | 10-373041 |
| Jul. 12, 1999 | (JP) | 11-198010 |
| Aug. 9, 1999 | (JP) | 11-225091 |

(51) Int. Cl.
*D21H 21/14* (2006.01)

(52) U.S. Cl. ..... 162/158; 162/147; 162/179

(58) Field of Classification Search ..... 162/158, 162/179, 147
See application file for complete search history.

(56) References Cited

U.S. PATENT DOCUMENTS

| | | | | |
|---|---|---|---|---|
| 2,694,633 A | | 11/1954 | Pattilloch et al. | |
| 2,772,967 A | * | 12/1956 | Padbury et al. | 162/179 |
| 3,293,114 A | | 12/1966 | Kenaga et al. | |
| 4,282,060 A | | 8/1981 | Maslanka et al. | |
| 4,309,182 A | | 1/1982 | Koll et al. | |
| 5,110,412 A | * | 5/1992 | Fuentes et al. | 162/147 |
| 5,232,553 A | * | 8/1993 | Smigo et al. | 162/147 |
| 5,296,024 A | | 3/1994 | Hutcheson | |
| 5,302,249 A | * | 4/1994 | Malhotra et al. | 162/164.4 |
| 5,393,334 A | * | 2/1995 | Hutcheson | 162/158 |
| 5,403,445 A | * | 4/1995 | Shimomura | 162/147 |
| 5,417,753 A | * | 5/1995 | Hutcheson | 162/158 |
| 5,614,062 A | * | 3/1997 | Schulte et al. | 162/147 |
| 5,679,218 A | * | 10/1997 | Vinson et al. | 162/109 |
| 5,695,607 A | * | 12/1997 | Oriaran et al. | 162/147 |
| 5,952,091 A | * | 9/1999 | Horand et al. | 162/147 |

FOREIGN PATENT DOCUMENTS

| | | |
|---|---|---|
| DE | 42 02 703 A1 | 8/1993 |
| EP | 0860547 A2 | 8/1998 |
| JP | 57101096 | 6/1982 |
| JP | 3269199 | 1/1991 |
| JP | 3124895 | 5/1991 |
| JP | 4185792 | 7/1992 |
| JP | 5230798 | 9/1993 |
| WO | WO9803730 | 7/1999 |

* cited by examiner

*Primary Examiner*—Peter Chin
(74) *Attorney, Agent, or Firm*—Birch, Stewart, Kolasch & Birch, LLP

(57) ABSTRACT

The present invention provides a paper quality improver for papermaking, for improving bulk value, brightness, and opacity of the pulp sheet. Further, the present invention provides a dry efficiency improver. A compound is used as the paper quality improver for papermaking, wherein the compound has less than 4% of lyotropic degree measured by a specific method and the compound satisfies at least two selected from (i) standard improved bulky value of not less than 0.02 g/cm$^3$, (ii) standard improved brightness of not less than 0.5 point and (iii) standard improved opacity of not less than 0.5 point. The compound is added internally into pulp slurry before or in papermaking step.

8 Claims, No Drawings

PAPER QUALITY IMPROVER FOR PAPERMAKING AND METHOD FOR PRODUCING PULP SHEET

TECHNICAL FIELD

The present invention relates to a paper quality improver for papermaking, which can improve bulky value and optical properties such as brightness and opacity of a sheet obtained from a pulp feedstock, and further relates to a method for producing a pulp sheet improving bulky value and optical properties such as brightness and opacity. Furthermore, the present invention relates to dry efficiency improver for a wet paper or water-squeezed product and relates to a method for drying.

PRIOR ART

From the viewpoint of conservation of the environment in earth, a reduction in the used amount of pulp is demanded. As a result, it has been demanded to make paper light and to increase the blending amount of deinked pulp. However, paper obtained by merely reducing the amount of pulp in the paper becomes thin so that its opacity becomes low. Thus, its quality becomes poor. According to the lightening of paper based on reducing the amount of pulp, about paper for which rigidity in proportion to cube of thickness is required, such as paperboard, its rigidity is unfavorably lowered. On the other hand, if the blending ratio of deinked pulp is raised, brightness is lowered by remaining ink or the like in the deinked pulp. Moreover, the pulp itself becomes skinny in recycle process so that the thickness of the resultant paper is lowered. Thus, its opacity becomes low. Accordingly, if amount of the pulp in paper is reduced and the blending ratio of deinked pulp is raised, the opacity and the brightness of the obtainable paper are lowered still more. Further, it is not preferable that opacity of obtained paper is reduced still more, if brightness of deinked pulp which makes brightness low is raised by deinking and/or bleaching.

In order to prevent the thickness of paper from being lowered by lightening the paper, hitherto various bulky value improving methods have been attempted. For example, about a producing method of making press pressure low, there arises a problem that smoothness is lowered so that printability becomes poor. Examples of the attempts also include methods in which a crosslinked pulp is used (JP-A 4-185792, etc), in which a mixture of pulp with synthetic fibers is used as a feedstock for papermaking (JP-A 3-269199, etc), in which spaces among pulp fibers are filled with a filler such as an inorganic substance (JP-A 3-124895, etc), and in which spaces are formed (JP-A 5-230798, etc). However, pulp cannot be recycled or smoothness of paper is damaged. As a paper bulking promoter, a specific alcohol and/or its polyoxyalkylene adduct are known (WO98/03730). The performance of fatty acid polyamide polyamines being commercially available as bulking promoters is insufficient.

On the other hand, in order to improve opacity and brightness, a method of adding a large amount (e.g., 5 to 20% by weight) of an inorganic filler, such as calcium carbonate, kaolin and white carbon has been carried out in the present industry. However, only if the inorganic filler is added in a large amount, the weight of paper increases remarkably. Even if the amount of pulp is reduced and the inorganic filler is added, it is impossible to make the paper light. In the case that the inorganic filler is added in particular to deinked pulp, a large amount of the inorganic filler is necessary. The lightening of the paper becomes increasingly difficult.

Further, a sizing agent composition for papermaking, which comprises an aqueous dispersion comprising a ketene dimer and a fatty acid sucrose ester, is also disclosed (JP-A 57-101096).

DISCLOSURE OF THE INVENTION

An object of the present invention is to solve the above-mentioned various problems associated with the lightening of paper and the increase in the amount of deinked pulp, and is specifically to provide a paper quality improver for papermaking which can attain at least two of improvements in bulky value, brightness and opacity due to modifying a surface of pulp. Further, another object is to provide a method by which a pulp sheet can be obtained and becomes to have at least two of improvements in bulky value, brightness and opacity.

The present invention provides a paper quality improver for papermaking; which is internally added before or in papermaking step; and comprises a compound having lyotropic degree defined below of not less than 4%, which provides at least two of any efficiencies selected from following paper quality improving efficiencies (i) to (iii):

(i) standard improved bulky value of at least 0.02 g/cm$^3$, (ii) standard improved brightness of at least 0.5 point, and (iii) standard improved opacity of at least 0.5 point; and $$\text{lyotropic degree (\%)}=(\alpha_0-\alpha)/\alpha_0\times 100$$

wherein $\alpha$: the water content in a wet sheet obtained by adding 5 parts by weight of the compound which is the paper quality improver for the papermaking to 100 parts by weight of pulp and subjecting the resultant to the papermaking, and $\alpha_0$: the water content in a wet sheet obtained by subjecting pulp to the papermaking without adding the compound which is the paper quality improver for papermaking to the pulp.

Further, the present invention is use of a compound having lyotropic degree as mentioned above of not less than 4% as a paper quality improver for the papermaking satisfying at least two selected from nay ones of the above-mentioned (i) to (iii).

Furthermore, the present invention provides a method for producing a pulp sheet, modified to satisfy at least two of any ones selected from the following (1) to (3), which comprises internally adding a compound having lyotropic degree above-defined of not less than 4% to a pulp slurry before or in the papermaking step; and provides a method for modifying a pulp sheet. And then, the present invention provides a pulp sheet obtained by the said method.

(1) improved bulky value of at least 0.02 g/cm$^3$, (2) improved brightness of at least 0.5 point, and (3) improved opacity of at least 0.5 point.

The following will describe a method for measuring the lyotropic degree, the standard improved bulky value, the standard improved brightness and the standard improved opacity according to the present invention, in detail.

[Method for Measuring the Lyotropic Degree]

(A) Pulp for Use

There is used a bleached hardwood pulp which is derived from a beech and whose Hunter's brightness (JIS P 8123) of a hand-made pulp sheet, prepared by the method for preparing hand-made paper for a pulp test according to JIS P 8209, is 80±5%. (This pulp is referred to as an LBKP hereinafter.)

(B) Measurement of the Lyotropic Degree

① A given amount of an LBKP is brushed out with a beater at 25±3° C. and then beaten into a Canadian standard freeness (JIS P 8121) of 460±10 ml so as to obtain an LBKP slurry whose pulp concentration is 1.0% by weight.

This pulp slurry is weighed out so that the basis weight of the LBKP of a sheet to be prepared by papermaking becomes 80±2 g/m$^2$. The pH thereof is then adjusted into 4.5 with aluminum sulfate, and subsequently 5 parts (net) by weight of an ethanol solution of 1.0% by weight of a paper quality improver for papermaking is added to 100 parts by weight of the pulp. The resultant is subjected to papermaking using a 150-mesh wire (area: 200 cm$^2$) in a circular TAPPI papermaking machine to obtain a wet sheet. Two filter paper shaving a basis weight of 320±20 g/m$^2$ (diameter: 185 mm) are stacked on the wet sheet, and further a coach plate is stacked thereon to perform coaching. Thereafter, the wet sheet is taken out. Next, the wet sheet is put between the above-mentioned two filter papers at upper-face and bottom-face therefrom and then is pressed at a pressure of 340±10 kPa for 5 minutes. After the press, the weight w(g) of the wet sheet is promptly measured.

Next, the wet sheet is dried at 105±3° C. for 60 minutes. The weight $W_d$ (g) of obtained dry sheet is measured.

② From the W and $W_d$ obtained as above, the water content α (%) is obtained by the formula (1):

$$\alpha\ (\%)=(W-W_d)/W\times 100 \quad (1)$$

Without adding any compound which is a paper quality improver for papermaking, a sheet is prepared in the same manner. The water content obtained in the same manner is represented by $\alpha_0$.

③ From the α and $\alpha_0$ obtained as above, the lyotropic degree is obtained by the following formula (2):

$$\text{lyotropic degree}\ (\%)=(\alpha_0-\alpha)/\alpha_0\times 100 \quad (2).$$

[Method for Measuring the Standard Improved Bulky Value]

① A given amount of an LBKP is brushed out with a beater at 25±3° C. and then beaten into a Canadian standard freeness (JIS P 8121) of 460±10 ml so as to obtain an LBKP slurry whose pulp concentration is 1.0% by weight.

This pulp slurry is weighed out so that the basis weight of the LBKP of a sheet to be prepared by papermaking becomes 80±0.5 g/m$^2$. The pH thereof is then adjusted into 4.5 with aluminum sulfate, and subsequently 0.5 parts (net) by weight of an ethanol solution of 1.0% by weight of a paper quality improver for papermaking is added to 100 parts by weight of the pulp. The resultant is subjected to papermaking using a 150-mesh wire (area: 200 cm$^2$) in a circular TAPPI paper machine to obtain a wet sheet. Two filter papers having a basis weight of 320±20 g/m$^2$ (diameter: 185 mm) is stacked on the wet sheet, and further a coach plate is stacked there on to perform coaching. Thereafter, the wet sheet is taken out. Next, the wet sheet is put between the above-mentioned two filter papers at upper-face and bottom-face thereform and then is pressed at a pressure of 340±10 kPa for 5 minutes. After the press, only the sheet is dried with a drum drier at 105±3° C. for 2 minutes. The moisture content in the dried sheet is regulated at a temperature of 20±1° C. and a humidity of 65±2% for 5 hours.

② The sheet having a regulated moisture content is weighed, and its basis weight (g/m$^2$) is obtained by the following calculating formula (3):

$$\text{basis weight}\ (g/m^2)=\text{sheet weight}/0.02 \quad (3).$$

Next, a micrometer for paper is used to measure the thickness of 10 points of the sheet having the regulated moisture content at a pressure of 54±5 kPa. The average of the obtained measuring values is made up as thickness (mm).

③ From the basis weight and the thickness obtained as above, bulk density d (g/cm$^3$) is obtained by the following formula (4):

$$d=(\text{basis weight})/(\text{thickness})\times 0.001 \quad (4).$$

Without adding any compound which is a paper quality improver for papermaking, a sheet is prepared in the same manner. The bulk density obtained in the same manner is represented by $d_0$.

④ From the bulk densities d and $d_0$ obtained as above, the standard improved bulky value is obtained by the formula (5):

$$\text{standard improved bulky value}\ (g/cm^3)=d_0-d \quad (5).$$

[Method for Measuring the Standard Improved Brightness]

① The same as ① about the method for measuring the standard improved bulky value.

② About a sheet having a regulated moisture content, its brightness B is measured according to Hunter's brightness in JIS P 8123. Without adding any compound which is a paper quality improver for papermaking, a sheet is prepared in the same manner. The brightness obtained in the same manner is represented by $B_0$.

③ From the brightness B and $B_0$ obtained as above, the standard improved brightness is obtained by the formula (6):

$$\text{standard improved brightness (point)}=B-B_0 \quad (6)$$

[Method for Measuring the Standard Improved Opacity]

① The same as ① about the method for measuring the standard improved bulky value.

② About a sheet having a regulated moisture content, its opacity P is measured according to JIS P 8138A.

Without adding any compound which is a paper quality improver for papermaking, a sheet is prepared in the same manner. The opacity obtained in the same manner is represented by $P_0$.

③ From the opacities P and $P_0$ obtained as above, the standard improved opacity is obtained by the formula (7):

$$\text{standard improved opacity (point)}=P-P_0 \quad (7).$$

As described above, an LBKP slurry of 1.0% by weight is prepared by the given method: ① to measure the lyotropic degree under the condition that the slurry of 5% by weight of pulp is added, and ② to measure the standard improved bulky value, the standard improved brightness and the standard improved opacity under the condition that the slurry of 0.5% by weight of pulp is added. In this way, the paper quality improver for papermaking of the present invention is easily specified.

The following describes the improved bulky value, the improved brightness and the improved opacity in the present invention. The above-mentioned (1) to (3) are respectively cited as improved values as compared with blank being added of the compound at papermaking. Herein, bulky value means same as the bulk density ($g/cm^3$) obtained from calculating basis weight ($g/m^2$) and thickness (mm) of pulp sheet using the following calculating formula:

bulk density=(basis weight)/(thickness)×0.001.

Further, brightness is measured with JIS P8123 Hunter's brightness, and opacity is measured with JIS P 8138A method.

According to the present invention, there is provided a paper quality improver for papermaking which achieves at least two of improvements in bulky value, brightness and opacity being desirable at lightening of paper and at increasing a blending amount of deinked pulp if small amount of the paper quality improver for papermaking is added. Further, according to the paper quality improver for papermaking of the present invention, it is also possible to obtain a pulp sheet having improved bulky value, brightness and opacity. Furthermore, according to the present invention, if a small amount of the paper quality improver for papermaking is added, there is provided a pulp sheet having at least two of improvements in bulky value, brightness and opacity being desirable at lightening of paper and at increasing a blending amount of deinked pulp. According to the present invention, there is provided a dry efficiency improver being able to easily improve a dry efficiency of a wet sheet or water-squeezed product, and there is provided a dry method being excellent in dry efficiency.

MODE FOR CARRYING OUT THE INVENTION

In the case of that the compound having lyotropic degree defined in the present invention of 4% or more, is added into pulp slurry to fix its pulp, the surface of the pulp is made hydrophobic. Therefore, the following can be considered. The interfacial tension between the pulp and the aqueous solution increases so that many voids are made between the pieces of the pulp during papermaking, there by to obtain a bulky pulp sheet. Optical reflectivity also becomes large, to obtain a pulp sheet having improved brightness and opacity. Even if only a part of the surface of the pulp is made hydrophobic so that the voids between the pieces of the pulp do not increase and high bulky value is less exhibited, for example, upon the addition of a small amount of the above-mentioned composition, the number of hydrogen bonds between the pieces of the pulp is reduced so that the surface area of the pulp increases. Thus, optical reflectivity increases to improve brightness and opacity. That is, the above-mentioned can be considered. The brightness can be calculated from lightness (the L value) and the b value. The larger the L value becomes, the larger the brightness becomes. And the smaller the b value becomes, the larger the brightness becomes. It is considerable that the efficiency for improving the brightness according to the present invention is achieved by an increase in the L value. Hitherto, the relationship between one member as the hydrophobicity of the surface of pulp and another member as bulky value and optical properties has not been known. The present inventor has however found that the both member have a correlation. Moreover, the inventor has found that in the case of using a compound having a lyotropic degree defined above of 4% or more, preferably 5% or more, a pulp sheet having improved bulk, brightness and opacity can be obtained even by the addition of a small amount thereof. The pulp sheet is a general term including paper and paperboard described in JIS P 0001.

The compound having lyotropic degree defined in the present invention of 4% or more, satisfies any two or more of the following (i) to (iii) defined in the present invention: (i) the standard improved bulky value is 0.02 $g/cm^3$ or more, preferably 0.025 $g/cm^3$ or more, and more preferably 0.03 $g/cm^3$; (ii) the standard brightness is 0.5 point or more, preferably 0.7 point or more, and more preferably 0.9 point or more; and (iii) the standard improved opacity is 0.5 point or more, preferably 0.7 point or more, more preferably 0.9 point or more. The composition satisfying the three of the (i) to (iii) is more preferable.

In the present invention, the compound having lyotropic degree of 4% or more is preferably an organic compound which has hydrophilic group for adhering onto a pulp surface and hydrophobic group for making the pulp surface hydrophobic. The compound having lyotropic degree of 4% or more can be selected from the group consisting of (A) organosiloxane, (B) glyceryl ether, (C) amide, (D) amine, (E) acid salt of amine, (F) quaternary ammonium salt, (G) imidazol, (H) ester of polyhydric alcohol and fatty acid and (I) alkylene oxide-added ester being an ester derived from polyhydric alcohol and fatty acid and having from more 0 mole to less 12 moles on average of $C_{2-4}$ alkylene oxide group per 1 mole of the ester.

(A) The organosiloxane may be cited as a methylpolysiloxane having a viscosity of 10 to 1,000,000 mPa·s at 25° C., a polyoxy ethylene methylpolysiloxane copolymer having HLB of 1 to 14 by Griffin's method, a poly (oxyethylene•oxypropylene)methylpolysiloxane copolymer having HLB of 1 to 14.

(B) The glyceryl ether may be a compound represented by the following formula (a):

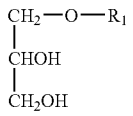

(a)

wherein $R_1$ has 8 to 35 carbon atoms and is an alkyl group, alkenyl group or β-hydroxyalkyl group.

(C) The amide, (b)–(c), (D) the amine, (d)–(f), (E) the acid salt of amine, (g), wherein the acid salt of amine may be ionized or non-ionized, (F) the quaternary ammonium salt, (h)–(i), (G) the imidazole (j) may be cited as compounds represented by the following formulas.

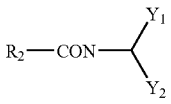

(b)

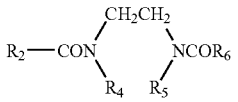

(c)

(d)

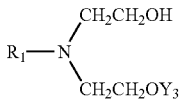

(e)

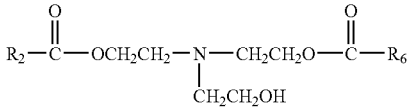

(f)

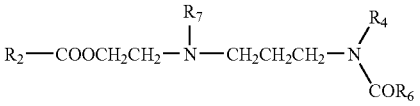

(g)

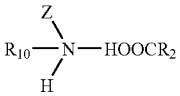

(h)

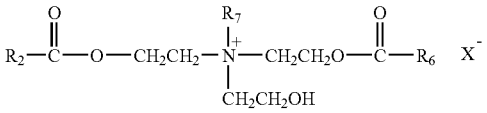

(i)

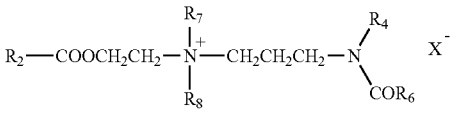

(j)

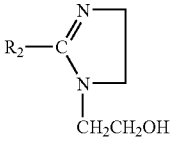

wherein $Y_1$ and $Y_2$ are same as or different from each other and represent a hydrogen atom, $R_4$, $R_6CO$, —$(AO)_n$—$COR_3$ or —$(AO)_n$—H; AO represents alkylene oxide having 2 to 4 carbon atoms; and $Y_3$ represents a hydrogen atom or —$COR_6$;

—$CH_2CH_2O(AO)_n$—$OCOR_9$ $R_1$ is the same as in the formula (a); $R_2$, $R_3$, $R_6$ and $R_9$ each represents an alkyl group, alkenyl group, or β-hydroxyalkyl group having 7 to 35 carbon atoms; $R_4$ and $R_5$ each represents a hydrogen atom or an alkyl group having 1 to 3 carbon atoms; $R_7$ and $R_8$ each represents an alkyl group having 1 to 3 carbon atoms; $R_{10}$ represents a hydrogen atom or $R_9$; n is an average number of added moles of 1 to 20; and $X^-$ represents an anionic ion.

The polyhydric alcohol which composes a compound of (H) or (I) is preferably a 2- to 14-hydric alcohol which may have an ether group and wherein the total number of carbon atoms is 2 to 24; more preferably a 2- to 8-hydric alcohol; and particularly preferably a 3- to 6-hydric alcohol. The dihydric alcohol may be cited as an alcohol which may have ether group and which have the total number of carbon atoms of 2 to 10, for example, propylene glycol, dipropylene glycol, butylene glycol, dibutylene glycol, ethylene glycol, diethylene glycol and polyethylene glycol. The trihydric alcohol may be cited as an alcohol which may have an ether group, wherein the total number of carbon atoms is 3 to 24 and wherein the total number of hydroxyl groups/the total number of carbon atoms in one molecule is 0.4 to 1, for example, glycerol, polyglycerol (average condensation degree: 2 to 5), pentaerythritol, dipentaerythritol, arabitol, sorbitol, stachyose, erythrite, mannite, glucose and sucrose. There may be more preferably cited as ethylene glycol, diethylene glycol, polyethylene glycol and a tri- or more-hydric alcohol which may have an ether group, wherein the total number of carbon atoms is 3 to 12 and wherein the total number of hydroxyl groups/the total number of carbon atoms in one molecule is 0.5 to 1. There may be particularly preferably cited as glycerol, polyglycerol (average condensation degree: 2 to 4) or pentaerythritol.

The fatty acid which composes these esters may be a fatty acid which has 1 to 24 carbon atoms and preferably has 10 to 22 carbon atoms, and which may be saturated or unsaturated and may be a straight chain or a branched chain. There may be particularly preferably cited as a straight chain fatty acid. There is more preferable to be lauric acid, myristic acid, palmitic acid, stearic acid, behenic acid and oleic acid. There is particularly preferable to be stearic acid.

This ester can be obtained by carrying out known esterifying reaction and alkylene oxide addition reaction. For example, a mixture of the fatty acid and the polyhydric alcohol is, optionally an esterifying catalyst is added thereto, reacted at 150 to 250° C. to obtain the ester. Further, an alkylene oxide having 2 to 4 carbon atoms is added thereto in the presence of an alkali catalyst or the like, to obtain the alkylene oxide added ester. On the other hand, alkylene oxide may be added to the fatty acid or the polyhydric alcohol, and the resultant may be esterified. In some case, the ester can be obtained by adding only alkylene oxide to the fatty acid.

About the average esterification degree of this ester, the OH groups of 1 mole of polyhydric alcohol are preferably substituted in a 10 to 95% equivalent. There is particularly preferable to have an ester group of 1 to 2 moles per mole of polyhydric alcohol.

When the alkylene oxide (referred to as AO hereinafter) added ester is used, the number of moles of AO added is on average from more than 0 mole to less than 12 moles, preferably from 0.1 to 6 moles, per mole of an ester. When a polyhydric alcohol, which can become an AO group, such as ethylene glycol, is used, the mole numbers thereof are also counted as the number of AO groups. The alkylene oxide is preferably ethylene oxide (referred to as EO hereinafter) or propylene oxide (referred to as PO hereinafter). It is allowable to use EO or PO alone, or to use a mixture of EO and PO. In the present invention, it is particularly preferable to use the ester of the polyhydric alcohol comprising no AO group with the fatty acid.

The liquid product of the paper quality improver for papermaking of the present invention may be added as it is. The solid product thereof may be pulverized, heated and melted, or diluted with water or the like to be added. If necessary, a nonionic, anionic, cationic or ampholytic surfactant may be used as an emulsifier or a dispersing agent for the paper quality improver for papermaking. There is preferable to be an anionic surfactant or a cationic surfactant. There is more preferable to be the following.

Salts of Higher Fatty Acids

For example, sodium, potassium and ammonium salts of stearic acid, oleic acid, palmitic acid, myristic acid, lauric acid, rhodinic acid, tall oil fatty acid.

Salts of Sulfate of Higher Alcohols

For example, sodium, potassium and ammonium salts of lauryl sulfate, myristyl sulfate, palmityl sulfate, stearyl sulfate and oleyl sulfate.

Salts of Alkylbenezene Sulfonic Acid

For example, sodium salt of straight chain dodecylbenzene sulfonic acid, and sodium salt of branched chain dodecylbenzene sulfonic acid.

Salts of Sulfosuccinic Acid Diester.

For example, sodium salt of di-2-ethylhexyl sulfosuccinate, sodium salt of diisotridecyl sulfosuccinate, and sulfosuccinic acid dicyclohexyl sulfosuccinic acid.

Naphthalene Sulfonic Salt-Formaldehyde Condensation

Salts of Polycarbonic Acid

For example, sodium, potassium, calcium and ammonium salts of polyacrylic acid, polymethacrylic acid and polymaleic acid; or sodium, potassium, calcium and ammonium salts of a copolymer derived from two or more selected from the group consisting of acrylic aid, methacrylic acid, maleic acid and styrene.

Quaternary Ammonium Salts

Hydrochloric salt and the like of lauryltrimethyl ammonium, cetyltrimethyl ammonium, stearyltrimethyl ammonium and distearyldimethyl ammonium and the like.

In this case, the ratio of the paper quality improver for papermaking of the present invention to the surfactant is as follows: the paper quality improver for papermaking of the present invention/the surfactant=99.9/0.1 to 70/30 (weight ratio) and preferably 99.8/0.2 to 80/20.

The paper quality improver for papermaking of the present invention is widely applicable to pulp feedstocks such as virgin pulps of mechanical pulps such as a thermomechanical pulp (TMP), and chemical pulps such as an LBKP; and pulps prepared from deinked pulps. When the deinked pulp is blended, the blended amount thereof is preferably 10% or more by weight, and more preferably 30% or more by weight, of the pulp feedstock.

The paper quality improver for papermaking of the present invention is added at anytime before or in papermaking step (internal addition). Before or in papermaking step to form paper layers by draining water from a diluted liquid of a pulp feedstock throughout the advance thereof on a wire netting; the paper quality improver for papermaking may be added, as added spot thereof, into brushing-out machine or a beater such as a pulper or a refiner; a tank such as a machine chest, a headbox, a white water tank; or a laying pipe connected to these facilities. A spot where a pulp feedstock can be uniformly blended, such as the refiner, the machine chest or the headbox is desirable as the added spot. It is preferable that the paper quality improver for papermaking of the present invention is added to a pulp feedstock and subsequently the resultant is, as it is, subjected to papermaking so that the majority of the improver remains in the resultant pulp sheet.

At the time of papermaking, it is allowable to add a sizing agent, a filler, a yield improver, a drainability improver, a paper strength improver, and the like. In particular, in order to exhibit the function of the paper quality improver for papermaking of the present invention, it is important that the improver is fixed onto pulp. For this, an agent for promoting to fix is preferably added. The agent for promoting to fix is aluminum sulfate, cationic starch, a compound having an acrylamide group, polyethylene imine, and the like. The added amount of the agent for promoting to fix is preferably from 0.01 to 5 parts by weight per 100 parts by weight of a pulp feedstock.

Even if the paper quality improver for papermaking of the present invention is added in a small amount of 0.01 to 5 parts, in particular 0.1 to 2 parts, by weight per 100 parts by weight of pulp feedstock; at least two of bulky value and optical properties such as brightness and opacity are improved.

The compound which is the paper quality improver for papermaking of the present invention can be used as a bulky value improver for papermaking, a brightness improver for papermaking, and an opacity improver for papermaking.

The paper quality improver for papermaking of the resent invention can be also used as dry efficiency improver. In this case, the paper quality improver for papermaking of the present can be widely allowable to use for a pulp feedstock such as virgin pulp including a mechanical pulp such as thermomechanical pulp (TMP) and including a chemical pulp such as LBKP; and for a pulp feedstock such as a deinked pulp.

The dry efficiency improver of the present invention is added at anytime before or in drying step of a wet sheet or a water-squeezed product. Preferably; the dry efficiency improver is added before or in papermaking step (adding step); next, the resultant is subjected to drying step. For the example, before or in papermaking step to form paper layers by draining water from a diluted liquid of a pulp feedstock throughout the advance thereof on a wire netting; the dry efficiency improver may be added into brushing-out machine or a beater such as a pulper or a refiner; a tank such as a machine chest, a headbox, a white water tank; or a laying pipe connected to these facilities. A spot where a pulp feedstock can be uniformly blended, such as the refiner, the machine chest or the headbox is desirable at adding. In the case of that the dry efficiency improver of the present invention is added to a pulp feedstock; and subsequently the resultant is, as it is, subjected to papermaking so that the majority of the improver remains in the resultant pulp sheet.

In order to exhibit the function of the dry efficiency improver of the present invention, it is important that the improver is fixed onto a wet pulp or a water-squeezed product. For this, an agent for promoting to fix is preferably added. The agent for promoting to fix is aluminum sulfate, cationic starch, a compound having an acrylamide group, polyethylene imine, and the like. The added amount of the agent for promoting to fix is preferably from 0.01 to 5 parts by weight per 100 parts by weight of pulp feedstock. Further, a flocculant is preferably used together. The flocculant is a chemical making a pulp used for treating such as papermaking, water-treatment and the like to be floc. For example, the flocculant may be polyacrylamide, polyetylene imine, starch, carboxymethyl cellulose. The flocculant is preferably polyacrylamide having high molecular. The added amount of the flocculant is preferably from 0.001 to 5% by weight, more preferably 0.01 to 1% by weight, and particularly preferably 0.01 to 0.5% by weight, per the pulp feedstock.

The dry efficiency improver of the present invention is added in a preferable amount of 0.01 to 10%, in a more preferable amount of 0.1 to 5%, in a particularly preferable amount of 0.1 to 2%, by weight per the pulp feedstock.

Concerning the pulp sheet obtained using the paper quality improver for papermaking of the present invention, its bulk density, which is an index of bulky value, is not less than 0.02 g/cm$^3$ and preferably not less than 0.03 g/cm$^3$ lower than that of an additive-free sheet. Its brightness is not less than 0.5 point and preferably not less than 0.7 point higher than that of an additive-free sheet, and its opacity is not less than 0.5 point and preferably not less than 0.7 point higher than that of an additive-free sheet.

Further, the pulp sheet obtained using the paper quality improver for papermaking of the present invention can be suitably used for paper such as a newspaper roll, paper for printing and data, wrapping paper, or paperboard in the category list which is mentioned in the handbook of the paper pulp craft (issued by Kami Pulp Gijyutsu Kyokai, P. 455–460, 1992).

EXAMPLES

Examples 1 to 46, Comparative Examples 1 to 12

In Examples, "parts" and "%" are parts by weight and % by weight, respectively, unless otherwise indicated.

[Paper Quality Improvers for Papermaking]

Tables 1 to 6 show compounds used as paper quality improvers for papermaking; and their lyotropic degrees, their standard improved bulky values, their standard improved brightnesses, and their standard improved opacity. At the time of measuring the lyotropic degrees, there was used a filter paper No. 26 (diameter: 185 mm, and basis weight: 320 g/m$^2$) provided by Advantec Toyo Co., Ltd.

TABLE 1

| Compound No. | Name of compounds | Lyotropic degree (%) | Standard improved bulky value (g/cm$^3$) | Standard improved brightness (point) | Standard improved opacity (point) |
|---|---|---|---|---|---|
| A-1 | Methylpolysiloxane (Shin-Etsu silicone KF96A-10) | 5.2 | 0.020 | 0.9 | 0.8 |
| A-2 | Methylpolysiloxane (Shin-Etsu silicone KF96A-1000) | 5.9 | 0.025 | 1.0 | 0.9 |
| A-3 | High polymerized methylpolysiloxane (Shin-Etsu silicone F96H-100,000) | 6.0 | 0.025 | 1.3 | 1.2 |
| A-4 | Polyoxyethylene-methylpolysiloxane copolymer (Shin-Etsu silicone KF353A) | 6.3 | 0.026 | 1.6 | 1.2 |
| A-5 | Polyoxyethylene-methylpolysiloxane copolymer (Shin-Etsu silicone KF945A) | 7.7 | 0.030 | 1.4 | 1.4 |
| A-6 | Poly (oxyethylene oxypropylene)-methylpolysiloxane copolymer (Shin-Etsu silicone KF6012) | 7.0 | 0.024 | 1.0 | 1.1 |

TABLE 2

| Compound No. | $R_1$ in the formula (a) | Lyotropic degree (%) | Standard improved bulky value (g/cm$^3$) | Standard improved brightness (point) | Standard improved opacity (point) |
|---|---|---|---|---|---|
| B-1 | $C_8H_{17}$ | 5.6 | 0.026 | 1.2 | 1.0 |
| B-2 | $C_{12}H_{25}$ | 6.6 | 0.028 | 1.5 | 1.1 |
| B-3 | $C_{18}H_{35}$ | 6.1 | 0.029 | 1.2 | 1.0 |
| B-4 | $C_{18}H_{37}$ | 5.3 | 0.022 | 1.0 | 0.8 |

TABLE 3

| Compound No. | Formulae and structures in the formulae | Lyotropic degree (%) | Standard improved bulky value (g/cm$^3$) | Standard improved brightness (point) | Standard improved opacity (point) |
|---|---|---|---|---|---|
| C-1 | (b) $R_2 = C_{17}H_{35}$ $Y_1 = CH_2CH_2OH$ $Y_2 = CH_2CH_2OCOC_{17}H_{35}$ | 5.9 | 0.022 | 1.2 | 0.9 |
| C-2 | (b) $R_2 = C_{17}H_{35}$ $Y_1 = Y_2 = CH_2CH_2OH$ | 6.9 | 0.020 | 0.8 | 0.9 |
| C-3 | (c) $R_2 = R_6 = C_{17}H_{35}$ $R_4 = R_5 = H$ | 6.6 | 0.024 | 1.1 | 1.3 |
| C-4 | (d) $R_1 = C_{18}H_{37}$ $Y_3 = COC_{15}H_{31}$ | 5.7 | 0.026 | 1.2 | 1.5 |
| C-5 | (d) $R_1 = C_{18}H_{37}$ $Y_3 = H$ | 5.4 | 0.025 | 1.1 | 1.6 |
| C-6 | (g) $R_2 = C_{17}H_{35}$ $R_{10} = H$ $Z = (CH_2CH_2O)_6—OCOC_{17}H_{35}$ | 6.4 | 0.026 | 1.3 | 1.4 |
| C-7 | (g) $R_2 = C_{15}H_{31}$ $R_{10} = H$ $Z{=}CH_2—CH(OH)CH_2OCOC_{17}H_{35}$ | 6.2 | 0.030 | 1.4 | 1.2 |

TABLE 3-continued

| Compound No. | Formulae and structures in the formulae | Lyotropic degree (%) | Standard improved bulky value (g/cm$^3$) | Standard improved brightness (point) | Standard improved opacity (point) |
|---|---|---|---|---|---|
| C-8 | (h) $R_2 = R_6 = C_{17}H_{35}$ $X^+ = CH_3COO^-$ $R_7 = CH_3$ | 6.0 | 0.024 | 1.3 | 1.1 |
| C-9 | (i) $R_2 = R_6 = C_{15}H_{31}$ $R_4 = H$ $R_7 = R_8 = CH_3$ $X^+ = CH_3COO^-$ | 5.5 | 0.023 | 1.2 | 0.7 |
| C-10 | (j) $R_2 = C_{17}H_{33}$ | 5.3 | 0.022 | 1.2 | 1.2 |

TABLE 4

| Compound No. | Name of compounds | Lyotropic degree (%) | Standard improved bulky value (g/cm$^3$) | Standard improved brightness (point) | Standard improved opacity (point) |
|---|---|---|---|---|---|
| D-1 | Stearic acid monoglyceride | 5.7 | 0.026 | 1.5 | 1.0 |
| D-2 | Pentaerythritol monooleate | 6.3 | 0.023 | 1.2 | 1.2 |
| D-3 | Sorbitan sesquioleate | 5.4 | 0.023 | 1.3 | 1.4 |
| D-4 | Sorbitol trilaurate | 5.5 | 0.025 | 1.3 | 1.3 |
| D-5 | Saccharose monooleate | 6.2 | 0.023 | 1.2 | 0.9 |
| D-6 | 1 mole of EO adduct to ethylene glycol monooleate | 5.6 | 0.026 | 1.6 | 1.5 |
| D-7 | 0.4 mole of PO adduct to monoglyceride laurate | 6.0 | 0.022 | 1.0 | 0.9 |
| D-8 | 2 moles of PO adduct to xylitol monostearate | 5.3 | 0.022 | 0.8 | 1.0 |
| D-9 | 6 moles of EO and 4 moles of PO block adduct to mannitol sesquioleate | 5.8 | 0.021 | 0.9 | 0.8 |
| D-10 | 2 moles of EO and 5 moles of PO random adduct to diethyleneglycol monodecylate | 5.2 | 0.020 | 1.0 | 0.8 |
| D-11 | Sorbitan tristearate | 5.1 | 0.012 | 0.8 | 0.7 |
| D-12 | Pentaerythritol stearate (average esterification degree: 45% by equivalent) | 5.2 | 0.028 | 1.4 | 1.6 |

TABLE 5

| Compound No. | Name of compounds | Lyotropic degree (%) | Standard improved bulky value (g/cm$^3$) | Standard improved brightness (point) | Standard improved opacity (point) |
|---|---|---|---|---|---|
| E-1 | Rosin soap (S-30 provided by Harima Chemicals Inc.) | 0.2 | 0.005 | 0.3 | 0.3 |
| E-2 | Alkylketene dimer (SKS-293F, provided by Arakawa Chemical Company) | 0.5 | 0.006 | 0.0 | 0.2 |

TABLE 5-continued

| Compound No. | Name of compounds | Lyotropic degree (%) | Standard improved bulky value (g/cm$^3$) | Standard improved brightness (point) | Standard improved opacity (point) |
|---|---|---|---|---|---|
| E-3 | Anhydrous alkenylsuccinic acid | 0.3 | 0.003 | 0.1 | −0.3 |
| E-4 | $C_{12-13}$ oxoalcohol | 2.5 | 0.010 | 0.0 | 0.1 |
| E-5 | 6 moles of EO adduct to lauryl alcohol | 2.7 | 0.011 | 0.3 | 0.1 |
| E-6 | Polyacryl amide (Polystron 356, provided by Arakawa Chemical Company) | 1.0 | 0.000 | −0.1 | 0.1 |
| E-7 | Hardened (hydrogenated) castor oil | 1.8 | 0.004 | 0.1 | 0.0 |
| E-8 | Commercially available bulking promoter "Bayvolume P liquid" (fatty acid polyamide polyaminde type, provided by Bayer AG) | 2.6 | 0.012 | 0.2 | 0.3 |

TABLE 6

| Compound No. | Lyotropic degree (%) | Standard improved bulky value (g/cm$^3$) | Standard improved brightness (point) | Standard improved opacity (point) |
|---|---|---|---|---|
| F-1 | 5.6 | 0.028 | 1.6 | 1.1 |
| F-2 | 5.8 | 0.026 | 1.3 | 1.3 |

F-1: A dispersion liquid having a 5% effective component prepared as follows: 4.5 g of pentaerythritol stearate (average esterification degree: 45% by equivalent) and 0.5 g of sodium dodecylsulfate were added to 95 g of warm water of 70° C. and then the resultant mixture was stirred to become homogeneous; thereafter, the resultant was left for 1 hour at 25° C.

F-2: A dispersion liquid having a 5% effective component prepared as follows: 4.0 g of pentaerythritol stearate (average esterification degree: 45% by equivalent) and 1.0 g of hydrochloric salt of cetyltrimethyl ammonium were added to 95 g of warm water of 70° C. and then the resultant mixture was stirred to become homogeneous; thereafter, the resultant was left for 1 hour at 25° C.

[Pulp Feedstocks]

A deinked pulp and a virgin pulp shown below were used as pulp feedstocks.

<Deinked Pulp>

A deinked pulp was obtained in the following manner. To 100 parts of feedstock wastepaper collected in the city (newspaper/leaflet=70/30%) were added warm water of 60° C., 1 part of sodium hydroxide, 3 parts of sodium silicate, 3 parts of a 30% aqueous hydrogen peroxide solution, and 0.3 part of EO PO (average number of moles added: EO 70 moles, and PO=10 moles) block adduct of beef tallow/glycerol (weight ratio=1:1), as a deinking agent. The feedstock was brushed out and then subjected to flotation. The resultant slurry was washed with water and regulated to a concentration of 1% to prepare a deinked pulp slurry. The Canadian standard freeness (JIS P 8121) of the deinked pulp slurry was 220 mL.

<Virgin Pulp>

Chemical pulp: A virgin pulp was used and prepared by brushing out and beating an LBKP (bleached hardwood pulp) with a beater at 25° C. to give a 1% LBKP slurry. The Canadian standard freeness (JIS P 8121) of the 1% LBKP slurry was 420 ml.

Mechanical pulp: A virgin pulp was used and prepared by brushing out TMP with hot water of 90° C. to give a 1% TMP slurry. The Canadian standard freeness (JIS P 8121) of the 1% TMP slurry was 100 ml.

[Papermaking Method-1]

Each of the deinked pulp slurry and the LBKP pulp slurry was weighed out in such an amount as to result in a sheet of paper having a basis weight of 60 g/m$^2$. The pH thereof was adjusted to 4.5 with aluminum sulfate. Subsequently, 0.5 part of each of various paper quality improvers for papermaking shown in Tables 1 to 6 was added to 100 parts of the pulp. Each resultant mixture was formed into a sheet with a rectangular TAPPI paper machine using an 80-mesh wire (area: 200 cm$^2$). The sheet obtained was pressed with a press machine at 3.5 kg/cm$^2$ for 2 minutes and dried with a drum dryer at 105° C. for 1 minute. After each dried sheet was held under the condition of 20° C. and a humidity of 65% for 1 day to regulate its moisture content; the bulk density, the brightness and the opacity of the sheet were measured in the following manner. Each of the measured values was the average of 10 measured values. The results obtained are shown in Tables 7 and 8.

<Evaluation Items and Methods>

Bulk Density

The basis weight (g/m$^2$) and thickness (mm) of each sheet having a regulated moisture content were measured, and its bulk density (g/cm$^3$) was determined from Equation for calculation:

$$\text{Bulk density}=(\text{basis weight})/(\text{thickness})\times 0.001.$$

The smaller the bulk density is, the higher the bulky value is. A difference of 0.02 in the bulk density is sufficiently recognized as a significant difference.

Brightness

This is according to Hunter's brightness defined in JIS P 8123. A difference of 0.5 point in the brightness is sufficiently recognized as a significant difference.

Opacity

This is according to JIS P 8138A. A difference of 0.5 point in the opacity is sufficiently recognized as a significant difference.

TABLE 7

| | | Deinked pulp | | | LBKP | | |
|---|---|---|---|---|---|---|---|
| Examples | Compound No. | Bulk density (g/cm$^3$) | Brightness (%) | Opacity (%) | Bulk density (g/cm$^3$) | Brightness (%) | Opacity (%) |
| 1 | A-1 | 0.355 | 53.5 | 90.9 | 0.393 | 82.3 | 83.3 |
| 2 | A-2 | 0.354 | 53.8 | 91.1 | 0.390 | 82.5 | 83.4 |
| 3 | A-3 | 0.347 | 53.9 | 91.3 | 0.389 | 82.7 | 83.7 |
| 4 | A-4 | 0.344 | 54.2 | 91.3 | 0.388 | 82.9 | 83.7 |
| 5 | A-5 | 0.340 | 54.4 | 91.5 | 0.382 | 83.1 | 84.1 |
| 6 | A-6 | 0.349 | 54.0 | 91.3 | 0.389 | 82.7 | 83.7 |
| 7 | B-1 | 0.346 | 53.9 | 91.1 | 0.387 | 82.6 | 83.6 |
| 8 | B-2 | 0.340 | 54.2 | 91.7 | 0.385 | 82.8 | 83.6 |
| 9 | B-3 | 0.341 | 54.1 | 91.6 | 0.385 | 82.9 | 83.5 |
| 10 | B-4 | 0.345 | 54.3 | 91.5 | 0.391 | 82.5 | 83.2 |
| 11 | C-1 | 0.350 | 53.7 | 91.2 | 0.392 | 82.4 | 83.3 |
| 12 | C-2 | 0.347 | 53.8 | 91.0 | 0.393 | 82.5 | 83.2 |
| 13 | C-3 | 0.342 | 54.3 | 91.8 | 0.387 | 82.7 | 83.6 |
| 14 | C-4 | 0.343 | 54.1 | 91.7 | 0.388 | 82.4 | 83.9 |
| 15 | C-5 | 0.344 | 54.0 | 91.4 | 0.386 | 82.3 | 83.9 |
| 16 | C-6 | 0.342 | 54.0 | 91.3 | 0.388 | 82.6 | 83.6 |
| 17 | C-7 | 0.341 | 54.1 | 91.8 | 0.381 | 83.1 | 84.4 |
| 18 | C-8 | 0.345 | 53.7 | 91.5 | 0.389 | 82.7 | 83.8 |
| 19 | C-9 | 0.348 | 53.5 | 91.3 | 0.389 | 82.8 | 83.5 |
| 20 | C-10 | 0.352 | 53.5 | 91.0 | 0.391 | 82.3 | 83.1 |
| 21 | D-1 | 0.343 | 54.3 | 91.7 | 0.386 | 82.7 | 83.9 |
| 22 | D-2 | 0.340 | 54.5 | 91.7 | 0.383 | 82.7 | 84.0 |
| 23 | D-3 | 0.349 | 54.0 | 91.2 | 0.389 | 82.4 | 83.6 |
| 24 | D-4 | 0.349 | 54.2 | 91.4 | 0.388 | 82.5 | 83.7 |
| 25 | D-5 | 0.341 | 54.5 | 91.5 | 0.386 | 82.9 | 83.7 |
| 26 | D-6 | 0.352 | 53.9 | 91.0 | 0.390 | 82.3 | 83.5 |
| 27 | D-7 | 0.345 | 54.1 | 91.2 | 0.388 | 82.5 | 83.7 |
| 28 | D-8 | 0.351 | 53.6 | 90.9 | 0.393 | 82.2 | 83.4 |
| 29 | D-9 | 0.347 | 54.2 | 91.4 | 0.390 | 82.5 | 83.5 |
| 30 | D-10 | 0.354 | 53.5 | 90.8 | 0.395 | 82.1 | 83.3 |
| 31 | D-11 | 0.359 | 53.6 | 90.7 | 0.406 | 82.2 | 82.7 |
| 32 | D-12 | 0.339 | 55.3 | 92.0 | 0.380 | 83.2 | 83.8 |
| 33 | F-1 | 0.342 | 55.1 | 91.8 | 0.380 | 82.9 | 84.0 |
| 34 | F-2 | 0.345 | 54.8 | 91.7 | 0.382 | 82.8 | 83.8 |

TABLE 8

| | | Deinked pulp | | | LBKP | | |
|---|---|---|---|---|---|---|---|
| Comparative examples | Compound No. | Bulk density (g/cm$^3$) | Brightness (%) | Opacity (%) | Bulk density (g/cm$^3$) | Brightness (%) | Opacity (%) |
| 1 | E-1 | 0.373 | 52.7 | 90.1 | 0.411 | 81.6 | 82.2 |
| 2 | E-2 | 0.370 | 52.6 | 90.3 | 0.410 | 81.3 | 82.1 |
| 3 | E-3 | 0.372 | 52.4 | 90.1 | 0.418 | 81.4 | 81.7 |
| 4 | E-4 | 0.366 | 52.9 | 90.7 | 0.410 | 81.5 | 82.1 |
| 5 | E-5 | 0.360 | 53.3 | 90.8 | 0.407 | 81.8 | 82.2 |
| 6 | E-6 | 0.375 | 52.7 | 90.4 | 0.413 | 81.1 | 81.8 |
| 7 | E-7 | 0.377 | 52.9 | 90.1 | 0.411 | 81.6 | 81.7 |
| 8 | E-8 | 0.371 | 52.9 | 90.5 | 0.412 | 81.4 | 81.9 |
| 9 | Blank | 0.376 | 52.8 | 90.3 | 0.416 | 81.3 | 81.9 |

[Papermaking Method-2]

Each of the deinked pulp slurry and the LBKP pulp slurry was weighed out in such an amount as to result in a sheet of paper having a basis weight of 60 g/m$^2$. Subsequently, 0.5 part of each of paper quality improvers for papermaking of the above-mentioned A-5, F-1, F-2 and E-1 was added to 100 parts of the pulp. Each resultant mixture was formed into a sheet with a rectangular TAPPI paper machine using an 80-mesh wire (area: 200 cm$^2$). The sheet obtained was pressed with a press machine at 3.5 kg/cm$^2$ for 2 minutes and dried with a drum dryer at 105° C. for 1 minute. After each dried sheet was held under the condition of 20° C. and a humidity of 65% for 1 day to regulate its moisture content, the bulk density, the brightness and the opacity of the sheet were measured in the above-mentioned manner. Each of the measured values was the average of 10 measured values. The results obtained are shown in Table 9.

TABLE 9

| | | Deinked pulp | | | LBKP | | |
|---|---|---|---|---|---|---|---|
| | Compound No. | Bulk density (g/cm$^3$) | Brightness (%) | Opacity (%) | Bulk density (g/cm$^3$) | Brightness (%) | Opacity (%) |
| Examples | | | | | | | |
| 35 | A-5 | 0.342 | 54.3 | 91.1 | 0.385 | 82.2 | 83.1 |
| 36 | F-1 | 0.339 | 54.8 | 91.6 | 0.377 | 82.7 | 84.2 |
| 37 | F-2 | 0.335 | 55.0 | 91.9 | 0.374 | 83.0 | 84.4 |
| Comparative examples | | | | | | | |
| 10 | E-1 | 0.368 | 52.9 | 90.8 | 0.411 | 80.9 | 82.3 |
| 11 | Blank | 0.366 | 53.0 | 90.5 | 0.408 | 81.2 | 82.1 |

[Papermaking Method-3]

A pulp slurry wherein the deinked pulp slurry and the TMP pulp slurry were mixed at a ratio of 50:50 was used, and 0.3 to 0.8 part of each of the paper quality improvers for papermaking was added to 100 pats of the pulp. According to the papermaking method-1, the preparation of sheets and the respective items were evaluated. The results obtained are shown in Table 10.

TABLE 10

| | | Added amount | Deinked pulp/TMP = 50/50 | | |
|---|---|---|---|---|---|
| | Compound No. | (% by weight of pulp) | Bulk density (g/cm$^3$) | Brightness (%) | Opacity (%) |
| Examples | | | | | |
| 38 | A-5 | 0.3 | 0.345 | 54.7 | 90.3 |
| 39 | | 0.5 | 0.330 | 55.2 | 90.6 |
| 40 | | 0.8 | 0.328 | 55.9 | 90.8 |
| 41 | B-3 | 0.3 | 0.344 | 54.9 | 90.4 |
| 42 | | 0.5 | 0.329 | 55.6 | 90.7 |
| 43 | | 0.8 | 0.320 | 56.0 | 91.1 |
| 44 | F-1 | 0.3 | 0.335 | 55.0 | 90.6 |

TABLE 10-continued

| | | Added amount | Deinked pulp/TMP = 50/50 | | |
|---|---|---|---|---|---|
| | Compound No. | (% by weight of pulp) | Bulk density (g/cm$^3$) | Brightness (%) | Opacity (%) |
| 45 | | 0.5 | 0.325 | 55.8 | 91.2 |
| 46 | | 0.8 | 0.318 | 56.3 | 91.5 |
| Comparative Examples | | | | | |
| 12 | Blank | — | 0.356 | 54.1 | 89.8 |

Concerning Tables 7 to 10, according to the paper quality improver for papermaking of the present invention, it is possible that about all of the deinked pulp, the virgin pulp (LBKP), and the mixture pulp of the deinked pulp and the virgin pulp (TMP); the bulky value, the brightness and the opacity for pulp sheets thereof are improved. In Example 31 (an example using a compound satisfying the standard improved brightness and standard improved opacity), Example 38, Example 41 and Example 44 (examples wherein the added amount of the paper quality improver for papermaking was 0.3% of the pulp), pulp sheets having improved brightness and opacity were obtained.

Example 47

[Dry Efficiency]

As pulp feedstock, (LBKP) having 2% of concentration and having regulated at 440 ml of freeness was used. During the resultant was stirred enough at 25° C., 1% per the pulp of the dry efficiency improver mentioned in Table 11 was added therein. The pulp concentration was diluted to 0.75%. 3% of aluminum sulfate per the pulp was added into a paper material. And then, from the resultant paper material, a hand-made sheet aiming 80 g/m$^2$ of the basis weight was formed using a sheet-machine for hand-made according to JIS P 8209. After that, the hand-made sheet was pressed under pressure of 3.5 kg/cm$^2$ (343.2 kPa) for 5 minutes by press machine, and then was dried with a rolling cylinder type drier at 105° C. During this, at given time, water content in wet sheet was measured, and the result is shown in Table 11.

Comparative Example 13

Wet sheet was dried in the same condition as Example 47 except that no dry efficiency improver was added. Water content in wet sheet was measured, and the result is shown in Table 11.

TABLE 11

| | Dry efficiency improver | | | | | | Water content (%) | |
|---|---|---|---|---|---|---|---|---|
| | Name of compounds | Lyotropic degree (%) | Standard improved bulky value (g/cm$^3$) | Standard improved brightness (point) | Standard improved opacity (point) | Added amount (%) | Before drying | After 30 minutes |
| Examples | | | | | | | | |
| 47-1 | Lauric alcohol | 5.4 | 0.022 | 1.2 | 0.8 | 1.0 | 80.8 | 3.5 |
| 47-2 | 15 moles of PO adduct to stearic alcohol | 5.6 | 0.025 | 1.1 | 0.9 | 1.0 | 80.7 | 2.0 |

TABLE 11-continued

| | Dry efficiency improver | | | | | | Water content (%) | |
|---|---|---|---|---|---|---|---|---|
| | Name of compounds | Lyotropic degree (%) | Standard improved bulky value ($g/cm^3$) | Standard improved brightness (point) | Standard improved opacity (point) | Added amount (%) | Before drying | After 30 minutes |
| 47-3 | Polyoxyethylene methyl polysiloxane copolymer (Shin-Etsu silicone KF94) | 7.7 | 0.030 | 1.4 | 1.4 | 1.0 | 79.1 | 0.0 |
| 47-4 | stearyl glyceryl ether | 5.3 | 0.022 | 1.0 | 0.8 | 1.0 | 80.9 | 4.3 |
| 47-5 | Compound G | 6.9 | 0.020 | 0.8 | 0.9 | 1.0 | 79.7 | 0.0 |
| 47-6 | Compound H | 5.4 | 0.025 | 1.1 | 1.6 | 1.0 | 80.8 | 3.5 |
| 47-7 | Palmitol trimethyl ammonium chloride | 5.2 | 0.021 | 0.9 | 1.3 | 1.0 | 81.0 | 5.0 |
| 47-8 | Compound I | 5.3 | 0.022 | 1.2 | 1.2 | 1.0 | 80.9 | 4.3 |
| 47-9 | Stearic acid monoglyceride | 5.7 | 0.026 | 1.5 | 1.0 | 1.0 | 80.6 | 1.3 |
| 47-10 | Pentaerythiltol stearate (average esterification degree: 45%) | 5.2 | 0.028 | 1.4 | 1.6 | 1.0 | 81.0 | 5.0 |
| 47-11 | 6 moles of EO adduct to sorbitan monolaurate | 5.2 | 0.026 | 1.4 | 0.9 | 1.0 | 81.0 | 5.0 |
| 47-12 | Compound J | 5.6 | 0.028 | 1.6 | 1.1 | 1.0 | 80.7 | 2.0 |
| 47-13 | Compound K | 5.8 | 0.026 | 1.3 | 1.3 | 1.0 | 80.5 | 0.5 |
| Comparative examples | | | | | | | | |
| 13 | None | — | — | — | — | — | 85.0 | 44.0 |

(Notes) Compounds G to K are the following.

Compound G:

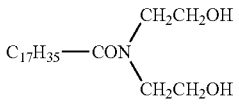

Compound H:

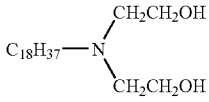

Compound I:

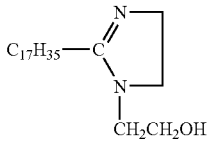

Compound J: A dispersion liquid having a 5% effective component prepared as follows: 4.5 g of pentaerythitol stearate (average esterification degree: 45%) and 0.5 g of sodium dodecylsulfate were added into 95 g of warm water of 70° C. and then the resultant mixture was stirred to become homogeneous; thereafter, the resultant was left for 1 hour at 25° C.

Compound K: A dispersion liquid having a 5% effective component prepared as follows: 4.0 g of pentaerythitol stearate (average esterification degree: 45%) and 11.0 g of hydrochloric salt of cetyltrimethyl ammonium were added into 95 g of warm water of 70° C. and then the resultant mixture was stirred to become homogeneous; thereafter the resultant was left for 1 hour at 25° C.

(Result)

Concerning Table 11, as dry efficiency improver of the present invention is added, it is understood that water content in the sheet after pressing (after drying) and after given time can be reduced.

The invention claimed is:

1. A method for producing a pulp sheet comprising the steps of taking a compound for improving paper making quality, wherein said compound has a lyotropic degree as defined below of not less than 4%, and said compound provides the following paper quality improving properties (i) to (iii):

(i) a standard improved bulky value of at least 0.02 $g/cm^3$, (ii) a standard improved brightness of at least 0.7 point, and (iii) a standard improved opacity of at least 0.7 point; and wherein $$\text{lyotropic degree (\%)}=(\alpha_0-\alpha)/\alpha_0\times 100$$

wherein $\alpha$ is the water content in a wet sheet obtained by adding 5 parts by weight of the compound to 100 parts by weight of pulp and subjecting the pulp to papermaking; and $\alpha_0$ is the water content in a wet sheet obtained by subjecting the pulp to papermaking without adding the compound to the pulp; and adding the compound and an agent that promotes fixation of the compound onto the paper sheet to a material pulp before or during a papermaking step, and producing a pulp sheet.

2. The method for producing a pulp sheet according to claim 1, wherein the agent that promotes fixation of the compound onto the paper sheet is selected from the group consisting of aluminum sulfate, a cationic starch, a compound having an acrylamide moiety and polyethylene imine.

3. The method for producing a pulp sheet according to claim 1, wherein the pulp sheet is used for a newspaper roll, a paper for printing and data, wrapping paper, or a paperboard.

4. The method for producing a pulp sheet according to claim 1, wherein the pulp is partially deinked.

5. The method for producing a pulp sheet according to claim 1, wherein said compound provides the following paper quality improving properties (i) to (iii):

(i) a standard improved bulky value of at least 0.02 g/cm$^3$, (ii) a standard improved brightness of at least 0.9 point, and (iii) a standard improved opacity of at least 0.9 point.

6. A method for producing a pulp sheet, modified to satisfy the following properties (1) to (3), (1) improved bulky value of at least 0.02 g/cm$^3$, (2) improved brightness of at least 0.7 point, and (3) improved opacity of at least 0.7 point said method comprising:

adding internally a compound having a lyotropic degree of not less than 4% and an agent that promotes fixation of the compound onto the paper sheet before or in a papermaking step into a material pulp, and subjecting the pulp to a papermaking:

wherein said lyotropic degree is defined by $$\text{lyotropic degree (\%)}=(\alpha_0-\alpha)/\alpha\times100$$

wherein $\alpha$: the water content in a wet sheet obtained by adding 5 parts by weight of the compound, which is a paper quality improver for the papermaking, to 100 parts by weight of pulp, and $\alpha_0$: the water content in a wet sheet obtained by subjecting pulp to the papermaking without adding the compound, which is the paper quality improver for the papermaking, to the pulp.

7. A modified pulp sheet which satisfies the following properties (1) to (3), (1) improved bulky value of at least 0.02 g/cm$^3$, (2) improved brightness of at least 0.7 point, and (3) improved opacity of at least 0.7 point, wherein said pulp sheet is obtained by internally adding the compound having the lyotropic degree of not less than 4% and an agent that promotes fixation of the compound onto the paper sheet into a material pulp before or in a papermaking step, and wherein said lyotropic degree is defined by $$\text{lyotropic degree (\%)}=(\alpha_0-\alpha)/\alpha\times100$$

wherein $\alpha$: the water content in a wet sheet obtained by adding 5 parts by weight of the compound, which is a paper quality improver for the papermaking, to 100 parts by weight of pulp, and $\alpha_0$: the water content in a wet sheet obtained by subjecting pulp to the papermaking without adding the compound, which is the paper quality improver for the papermaking, to the pulp.

8. A method for producing a pulp sheet comprising the steps of:

taking a compound for improving paper making quality, wherein said compound has a lyotropic degree as defined below of not less than 4%, and said compound provides the following paper quality improving properties (i) to (iii):

(i) a standard improved bulky value of at least 0.02 g/cm$^3$, (ii) a standard improved brightness of at least 0.7 point, and (iii) a standard improved opacity of at least 0.7 point; and wherein the $$\text{lyotropic degree (\%)}=(\alpha_0-\alpha)/\alpha_0\times100$$

wherein $\alpha$ is the water content in a wet sheet obtained by adding 5 parts by weight of the compound to 100 parts by weight of the pulp and subjecting the pulp to papermaking; and $\alpha_0$ is the water content in a wet sheet obtained by subjecting the pulp to papermaking without adding the compound to the pulp; and adding the compound and an agent that promotes fixation of the compound onto the paper sheet to a material pulp before or during a papermaking step, wherein said material pulp contains a deinked pulp in an amount of 10% or more by weight in the material pulp, and producing a pulp sheet.

* * * * *